US010544522B2

(12) United States Patent
Loos et al.

(10) Patent No.: US 10,544,522 B2
(45) Date of Patent: Jan. 28, 2020

(54) THREAD DRAW-OFF NOZZLE FOR AN OPEN-END SPINNING DEVICE

(71) Applicant: Rieter Ingolstadt GmbH, Ingolstadt (DE)

(72) Inventors: Bernd Loos, Deggingen (DE); Frank Riedel, Ebersbach (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 423 days.

(21) Appl. No.: 15/603,569

(22) Filed: May 24, 2017

(65) Prior Publication Data

US 2017/0342605 A1 Nov. 30, 2017

(30) Foreign Application Priority Data

May 25, 2016 (DE) ..... 10 2016 109 687

(51) Int. Cl.
*D01H 4/40* (2006.01)

(52) U.S. Cl.
CPC ..... *D01H 4/40* (2013.01)

(58) Field of Classification Search
CPC ..... D01H 4/40; D01H 4/38
USPC ..... 57/417
See application file for complete search history.

(56) References Cited

U.S. PATENT DOCUMENTS 3,328,949 A * 7/1967 Pavek ..... D01H 4/40 57/414
4,854,119 A * 8/1989 Stahlecker ..... D01H 4/40 57/417
5,265,406 A * 11/1993 Hofmann ..... D01H 4/40 57/417
6,347,506 B1 2/2002 Backmeister
6,886,321 B2 5/2005 Sonntag et al.
7,036,301 B2 5/2006 Wassenhoven
2005/0011178 A1* 1/2005 Weide ..... D01H 4/40 57/417
2005/0229580 A1* 10/2005 Baur ..... D01H 4/40 57/417
2006/0137321 A1 6/2006 Gatzke et al.

FOREIGN PATENT DOCUMENTS

DE 23 33 401 A1 1/1975
DE 37 29 425 A1 9/1988
DE 199 06 111 A1 10/2000
DE 103 26 847 A1 9/2004
DE 103 30 767 A1 2/2005
EP 1 445 359 B1 1/2004
EP 1 367 154 B2 6/2012
JP S 49112925 U 9/1974

OTHER PUBLICATIONS

German Patent Office Search Report, dated Jan. 13, 2017.
EP Search Report, dated Nov. 8, 2017.

* cited by examiner

*Primary Examiner* — Tajash D Patel
(74) *Attorney, Agent, or Firm* — Dority & Manning, P.A.

(57) ABSTRACT

A thread draw-off nozzle for an open-end spinning device includes a nozzle insert configured to deflect a yarn produced by the open-end spinning device. A nozzle frame fixes the thread draw-off nozzle in the open-end spinning device. The nozzle frame includes a cylindrical shank, which has a centering diameter and a length that is shorter than half the centering diameter.

10 Claims, 3 Drawing Sheets

THREAD DRAW-OFF NOZZLE FOR AN OPEN-END SPINNING DEVICE

FIELD OF THE INVENTION

The present invention relates to a thread draw-off nozzle for an open-end spinning device with a nozzle insert for deflecting a produced yarn and with a nozzle frame, by means of which the thread draw-off nozzle can be fixed in the open-end spinning device. The nozzle frame features a cylindrical shank.

BACKGROUND

Thread draw-off nozzles for open-end spinning devices have become known in the prior art in many different designs. The thread draw-off nozzles have the task of deflecting the spun yarn upon its drawing off from the spinning device, and of imparting a false twist to the drawn yarn. As a result, spinning stability can be substantially increased and a uniform yarn can be produced. When drawn off based on the rotation of the spinning rotor, the yarn circulates in the manner of a crank on the yarn deflecting surface of the thread draw-off nozzle, such that a relatively high temperature stress along with wear occurs at the thread draw-off nozzles, which can adversely affect the spinning process.

Therefore, in the prior art, common draw-off nozzles are designed in two parts and consist of a nozzle insert that contains the yarn-deflecting surface and is usually made of a ceramic material, along with a nozzle frame that carries the nozzle insert and serves to attach the thread draw-off nozzle in the open-end spinning device. In order to fix the thread draw-off nozzle in the open-end spinning device in an interchangeable manner, and thereby, upon a change of the material to be spun, undertake an adjustment of the draw-off nozzle, the shank of the draw-off nozzle or the nozzle frame is provided with a thread, such that the thread draw-off nozzle can be screwed into the open-end spinning device. Such a thread draw-off nozzle is shown, for example, in DE 103 30 767 A1. In principle, thread draw-off nozzles of this type have proven themselves, but have a comparatively large space requirement. However, with today's requirements for ever-increasing productivity, which are associated with ever higher rotor speeds of 160,000 rpm and higher and ever smaller rotor diameters, problems with accommodating thread draw-off nozzles in the open-end spinning device are increasingly arising. Thus, in addition to the draw-off nozzle, the fiber feed channel must also be accommodated in the part of the open-end spinning device carrying the thread draw-off nozzle, which can also be designed in the form of a channel plate adapter, whereas both must be accommodated in an extension within the opening of the spinning rotor.

Therefore, thread draw-off nozzles that get by without a nozzle frame have already been proposed. For example, EP 1 367 154 B2 shows a thread draw-off nozzle, which consists of ceramic and is directly pressed into a corresponding receiving bore of a channel plate adapter. Given the absence of a nozzle frame, the space requirement of the draw-off nozzle can be reduced, but, upon the replacement of the draw-off nozzle, it is necessary to replace the entire channel plate adapter.

EP 1 445 359 B1 also shows a draw-off nozzle that can get by without a nozzle frame. Herein, the channel plate adapter, which accommodates the nozzle, is at least partially made of a plastic material and features a clip closure and centering members for receiving the thread draw-off nozzle. The thread draw-off nozzle, which consists only of a nozzle insert, can be clipped into the channel plate adapter made of a plastic material. The replacement of the draw-off nozzle is easily possible; however, damage to the clip device can occur.

With the two thread draw-off nozzles last mentioned above, it is disadvantageous that separate molds are required for manufacturing the ceramic thread draw-off nozzles, in order to attach the extensions or the like for pressing or clipping into the open-end spinning device However, this is profitable only with very large unit numbers.

SUMMARY OF THE INVENTION

Therefore, a task of this invention is to provide a thread draw-off nozzle that has only a small space requirement and can be manufactured cost-effectively. Additional objects and advantages of the invention will be set forth in part in the following description, or may be obvious from the description, or may be learned through practice of the invention.

A thread draw-off nozzle for an open-end spinning device features a nozzle insert for deflecting a produced yarn and a nozzle frame by means of which the thread draw-off nozzle can be attached in the open-end spinning device. Herein, the nozzle frame features a cylindrical shank. It is provided that the shank of the nozzle frame is provided with a centering diameter and that the cylindrical shank is shorter than half the centering diameter. The length of the shank is understood here to be the extension of the shank in the direction of the axis of the cylinder. With this arrangement, it is now achieved that the shank, which is distinctly long compared to conventional thread draw-off nozzles, is now reduced to a minimum, such that the thread draw-off nozzle features only an extremely small structural height and thus can also be used in connection with very small spinning rotors with diameters of less than 28 mm or even less than 26 mm. However, on the basis of the fact that a nozzle frame is still provided, conventional nozzle inserts made of ceramic can be used, which can be manufactured with existing tools. The shank of the nozzle frame is only in place as long as this is required for the centering of the thread draw-off nozzle in the open-end spinning device by means of the shank. Therefore, compared to a conventional nozzle frame with a screw shank, it can be made much shorter. Nevertheless, the thread draw-off nozzle is easily fixed in the open-end spinning device in an interchangeable manner.

It is particularly advantageous if the nozzle frame consists of a metallic material, in particular a steel material or an aluminum material. Due to the metallic material of the nozzle frame, a particularly good heat dissipation from the thread draw-off nozzle to the open-end spinning device can be achieved, which is not possible with a nozzle entirely consisting of a ceramic material. At the same time, the nozzle insert is protected from damage, especially during handling, by the nozzle frame made of a metallic material.

The heat dissipation from the thread draw-off nozzle may be further improved if the nozzle frame features a nozzle plate that is formed to be flat. The nozzle plate forms an additional contact surface with the open-end spinning device, and thereby improves heat dissipation. In addition, the nozzle plate imparts upon the nozzle frame a high degree of stability, such that damage to the thread draw-off nozzle can be avoided when it is attached in the open-end spinning device or during handling.

In order to attach the thread draw-off nozzle in the open-end spinning device, it is also advantageous if the nozzle frame consists of a ferromagnetic material, in particular a steel material, or features a ferromagnetic insert. The thread draw-off nozzle can thus be attached by magnetic forces in the open-end spinning device, such that the cylindrical shank of the nozzle frame serves only to center the thread draw-off nozzle in the open-end spinning device and no longer to attach the thread draw-off nozzle As such, the shank can also be designed to be particularly short and, for example, may feature a length of 3 mm or less.

However, in place of the magnetic attachment, it is also possible to attach the thread draw-off nozzle in the open-end spinning device by means of attachment; for example, one or more threaded pins. Moreover, the attachment by means of a threaded pin requires only a very small space requirement, such that the shank of the nozzle frame can be designed to be very short.

According to an additional form of the thread draw-off nozzle, it can be advantageous if the shank of the nozzle frame features a recess for receiving a tip of an attachment means. Thereby, the thread draw-off nozzle can be fixed particularly well in the open-end spinning device. In addition, such a recess at the same time makes it possible to position the thread draw-off nozzle in its circumferential direction, if it features an asymmetrical structure.

Furthermore, it is advantageous if the nozzle insert consists of a ceramic material. This is particularly resistant to wear and offers great freedom in the design of surface structures of the nozzle insert, which are intended to introduce a false twist to the yarn. Such surface structures can be designed, for example, as notches or spirals. In addition, the ceramic material features a high wear resistance and provides a smooth surface.

Furthermore, it is advantageous if the nozzle insert is glued into the nozzle frame. Thereby, the manufacturing of the thread draw-off nozzle is particularly simple and can be realized cost-effectively.

To connect the nozzle insert to the nozzle frame by gluing, it is also advantageous if the nozzle frame features a ring-shaped adhesive surface that is oriented in a perpendicular manner to a circumferential surface of the cylindrical shank, which corresponds to a ring-shaped adhesive surface of the nozzle insert. Such an adhesive surface can be provided, for example, in the form of a ring-shaped, stepped elevation on the nozzle frame or in the form of a stepped recess on the nozzle insert. By providing a defined adhesive surface in both components, a particularly uniform and narrow adhesive gap can be achieved. At the same time, through the adhesive surface, a defined contact is created for heat dissipation from the nozzle insert through the nozzle frame, whereas the heat transfer is barely affected by the very thin adhesive layer.

It is also advantageous if the nozzle plate or a top edge of the nozzle plate turned towards the nozzle insert is arranged at a distance from a lower edge of the nozzle insert. This embodiment contributes to a defined, two-dimensional contact between the nozzle frame and the nozzle existing in the area of the adhesive surface.

It is also advantageous if an outer diameter of the thread draw-off nozzle is less than 18 mm, preferably less than 16 mm and more preferably less than 14 mm. This contributes to the fact that the thread draw-off nozzle features an extremely small space requirement, and can therefore also be used without any problems in very small spinning rotors with a diameter of 26 mm and less.

BRIEF DESCRIPTION OF THE DRAWINGS

Additional advantages of the invention are described on the basis of the following presented embodiments. The following is shown.

DETAILED DESCRIPTION

Figure 1:
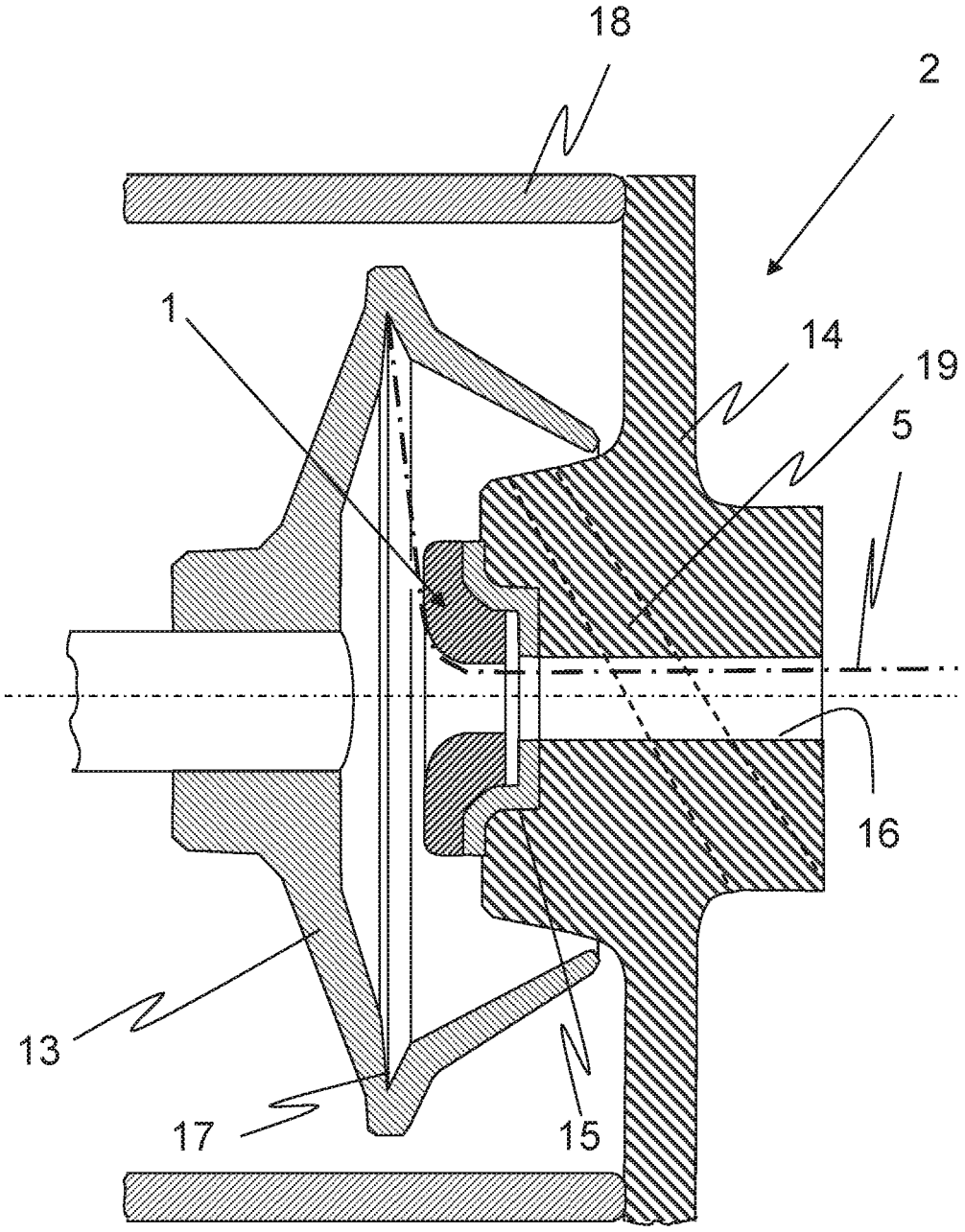
FIG. 1 is an open-end spinning device with a thread draw-off nozzle in a sectional overview illustration.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic sectional illustration of a spinning rotor 13 along with a thread draw-off nozzle 1 in an open-end spinning device 2, which is only partially shown. From the open-end spinning device 2, a cover element 14 is shown that closes a rotor housing 18 (which is shown here only broken off) during the operation of the open-end spinning device 2. The open-end spinning device 2 also has a spinning rotor 13, which rotates at a high rotational speed in a known manner, into which a spinning material separated into individual fibers is fed through a fiber feed channel 19 (dashed line). Herein, the fiber feed channel 19 passes through the cover element 14 and ends in an extension of the cover element projecting into the opening of the spinning rotor 13. By way of derogation from the illustration shown, the extension that projects into the opening of the spinning rotor 13 can also be arranged on a channel plate adapter that can be fixed in the cover element 14 in an interchangeable manner.

The fiber material to be fed is incorporated into the end of the already spun yarn 5 based on the rotation of the spinning rotor 13, such that the yarn 5 is continuously drawn off of the spinning rotor 13 through the thread draw-off nozzle 1 and a yarn draw-off channel 16 of the cover element 14. As a result of the rotation of the spinning rotor 3, the yarn end reaching into the rotor groove 17 circulates in the manner of a crank, and herein sweeps over a yarn deflecting surface of the thread draw-off nozzle 1. Therefore, the thread draw-off nozzle 1 is exposed to considerable thermal loads and an abrasive action of the yarn 5. The thread draw-off nozzle 1 is likewise attached to the extension of the cover element 14 (or of a channel plate adapter) projecting into the interior of the spinning rotor 13. For inserting the thread draw-off nozzle 1 into the cover element 14, the latter features a correspondingly shaped receptacle 15.

Figure 2:
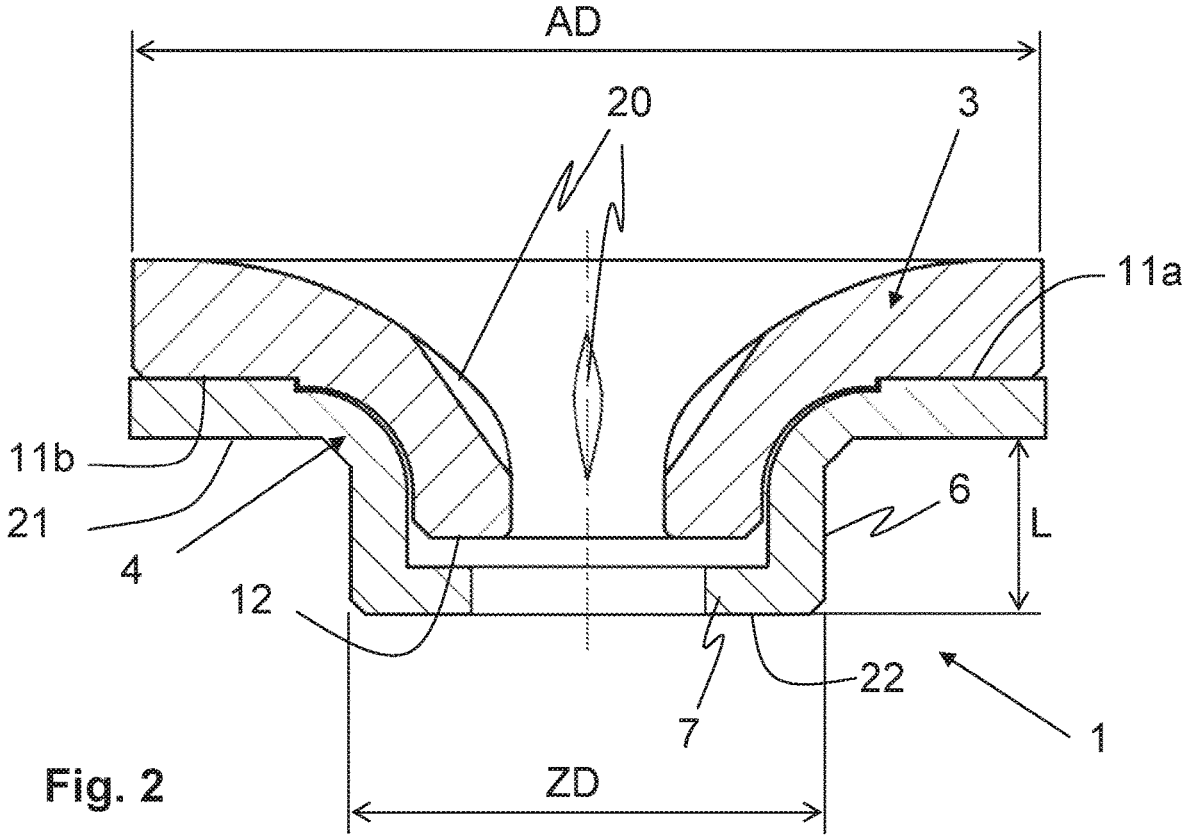
FIG. 2 is a sectional illustration of a thread draw-off nozzle with a nozzle insert and a nozzle frame according to a first embodiment.

FIG. 2 shows a sectional detail illustration of a thread draw-off nozzle 1 according to a first embodiment. The thread draw-off nozzle 1 is designed in two parts with a nozzle frame 4 along with and a nozzle insert 3, which, with the present invention, are connected to one another by adhesive bonding. For this purpose, the nozzle frame features an adhesive surface 11*a*, which is oriented perpendicularly to a shank 6 of the nozzle frame 4, in the form of a ring-shaped indent, which corresponds to an adhesive surface 11*b* of the nozzle insert provided in the form of a ring-shaped stepped recess. As can be seen in FIG. 2, the nozzle insert 3 and the nozzle frame 4 are configured in such a manner that they only come into contact with one another through the adhesive surfaces 11*a* and 11*b*. Through this configuration, a very narrow and defined adhesive gap is achieved, such that only a very thin layer of adhesive is necessary, and thus the heat-conducting contact between the nozzle frame 4 and the nozzle insert 3 is provided.

The nozzle insert 3 is preferably designed as a ceramic insert in a conventional manner, and is thus particularly resistant to wear. Furthermore, in a simple manner, the embodiment of the nozzle insert 3 made of a ceramic material enables the introduction of surface structures 20, such as notches or spirals, which improve the technological effect of the thread draw-off nozzle 1.

On the other hand, the nozzle frame 4 is produced from a metallic material, in particular a steel material, and thus enables good heat dissipation of the temperature for the open-end spinning device 2 arising in the nozzle insert 3. At the same time, the production of the nozzle frame 4 made of a steel material easily enables the fixing of the thread draw-off nozzle 1 in the open-end spinning device 2 by means of a magnetic fastener. For this purpose, the nozzle frame 4 features a contact surface 21 that is likewise ring-shaped, which interacts with permanent magnets of the open-end spinning device (not shown).

Thus, the shank 6 of the nozzle frame 4 no longer serves to attach the thread draw-off nozzle 1 in the open-end spinning device, and can therefore be designed to be particularly short. With the embodiment shown here, the shank 6 solely serves to center the thread draw-off nozzle in the open-end spinning device 2, and is provided with a centering diameter ZD for this purpose. Therefore, the length L of the shank 6, which extends between the ring-shaped contact surface 21 and a lower edge 22 of the nozzle frame 4, can be reduced to a minimum and is shorter than half of the centering diameter ZD. Thereby, the thread draw-off nozzle can be produced in a particularly compact shape with only a small space requirement, and thus, even with very small spinning rotors with a diameter of 26 mm and less, can also be easily accommodated in the cover element 14 or in a channel plate adapter. It is also particularly advantageous if the outer diameter AD, which in the present case also corresponds to a head diameter of the thread draw-off nozzle 1, is also designed to be particularly small and amounts to, for example, less than 16 mm.

The present thread draw-off nozzle 1 can be produced particularly cost-effectively, since conventional ceramic nozzle inserts 3 from previously known thread draw-off nozzles can be easily reused. With the thread draw-off nozzle 1, it is also particularly advantageous that, based on the ring-shaped contact surface 21, it can be positioned very accurately with respect to its position or its distance from the rotor groove 17, since tilting can largely be ruled out.

Figure 3:
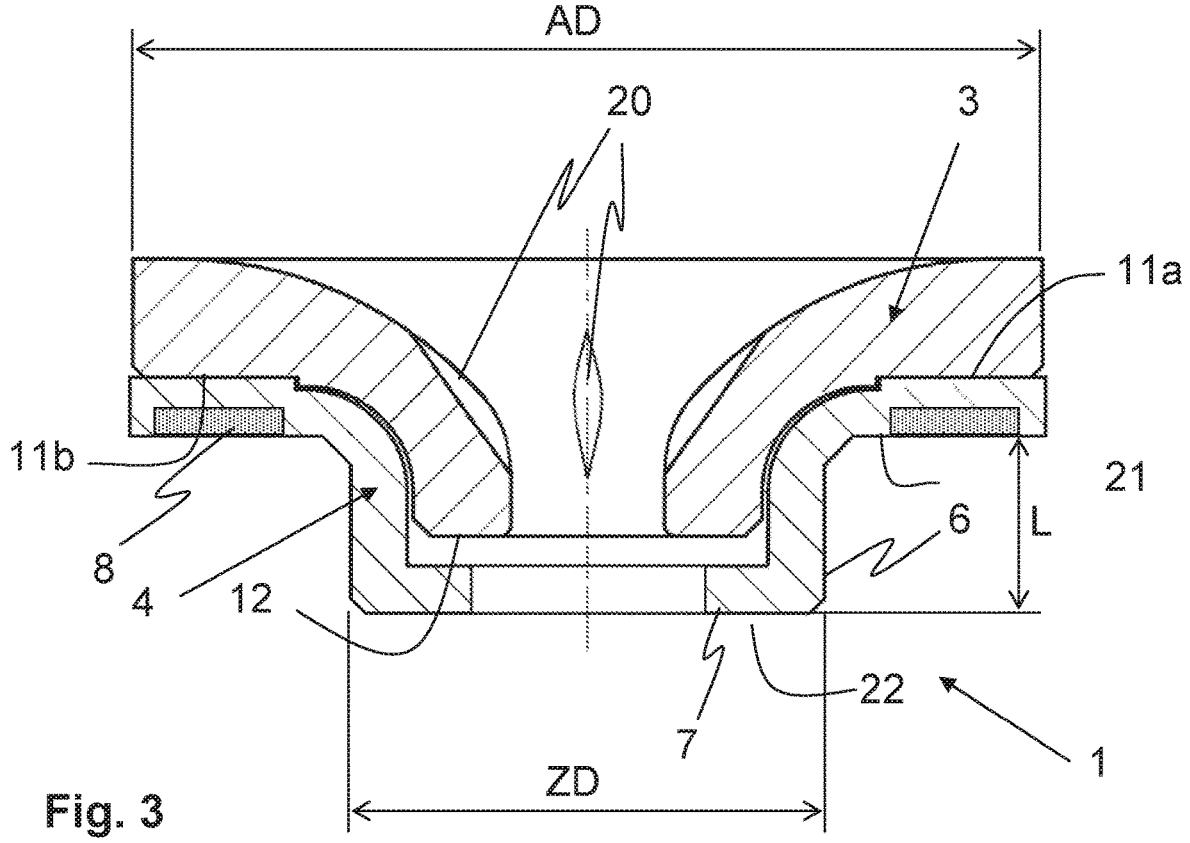
FIG. 3 is a sectional illustration of a thread draw-off nozzle with a nozzle insert and a nozzle frame with a ferromagnetic insert.

FIG. 3 shows another embodiment of a thread draw-off nozzle 1, which can also be fixed in the open-end spinning device 2 by means of a magnetic fastener. Herein, the same components are provided with the same reference signs as with the draw-off nozzle 1 of FIG. 2. Therefore, only the differences with the embodiment of FIG. 2 will be discussed below.

For magnetic attachment, the thread draw-off nozzle 1 in accordance with FIG. 3 features a ferromagnetic insert 8, which can be designed to be ring-shaped, for example, or can be formed by at least two separate inserts 8, which are arranged on sides opposite to each other. Therefore, it is not necessary to produce the nozzle frame 4 from a steel material; rather, independently of the magnetic properties, a material with a particularly good thermal conductivity, for example an aluminum material, can be used. As described above, the connection between the nozzle insert 3 and the nozzle frame 4 can be effected by means of an adhesive connection through the adhesive surfaces 11*a* and 11*b*.

However, by way of derogation from the illustrations shown in FIGS. 2 and 3, it is not absolutely necessary to provide a defined, ring-shaped adhesive surface 11*a*, 11 *b* by means of an indent. Likewise, the opposing surfaces of the nozzle frame 4 and the nozzle insert 3, which are to be glued to one another, could also be formed without an indent, and thus without a firmly fixed adhesive surface 11*a*, 11*b*, as shown, for example, in FIG. 4. However, for the reasons mentioned above, a defined adhesive surface with a uniform adhesive gap is advantageous.

Furthermore, the thread draw-off nozzles 1 or the nozzle frames 4 of FIGS. 2 and 3 both feature a nozzle plate 7, which encloses the nozzle insert 3 of the thread draw-off nozzle on its underside, which is turned away from the spinning rotor 13 in operation. The nozzle plate 7 imparts upon the nozzle frame 4 a high degree of stability and protects it from damage. In addition, with its underside, the nozzle plate 7 provides an additional contact surface for a heat-conducting contact with the open-end spinning device 2, as can be particularly seen in FIG. 1. Therefore, the heat dissipation of such a thread draw-off nozzle to the open-end spinning device 2 is particularly good, and overheating on the surface of the nozzle insert 3 can thus be avoided. In principle, however, it is likewise conceivable to design the nozzle frame 4 without a nozzle plate 7, as is shown, for example, in FIG. 5.

Figure 4:
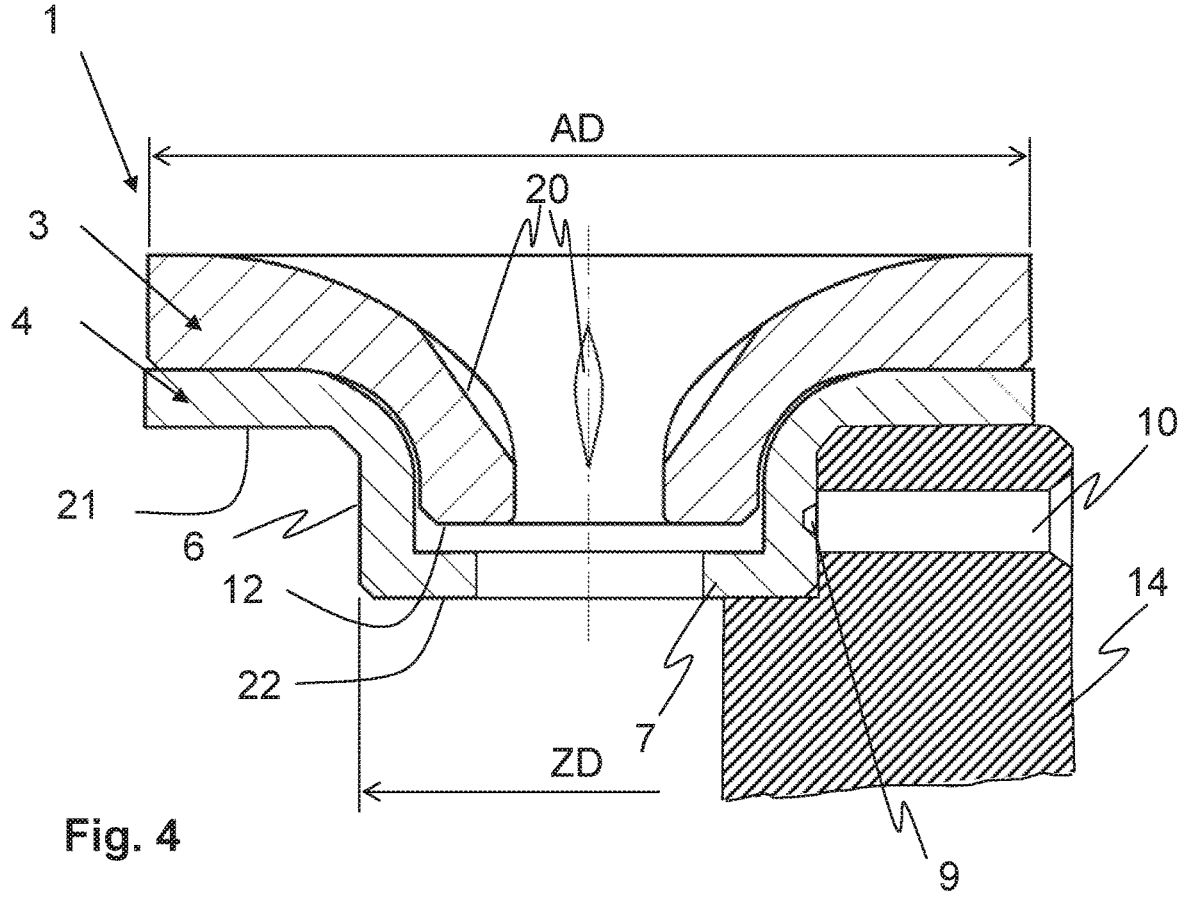
FIG. 4 is a sectional illustration of a thread draw-off nozzle with a nozzle insert and a nozzle frame according to an additional embodiment.

FIG. 4 shows an additional embodiment of a thread draw-off nozzle 1, which is not attached magnetically; rather, it is attached in the open-end spinning device 2 by means of a threaded pin (not shown). For this purpose, the cover element 14 is provided with a threaded bore 10, into which the threaded pin can be inserted, and thereby fixes the thread draw-off nozzle 1 in the cover element 14 through the shank 6 of the nozzle frame 4.

Here, as shown with the present invention, a recess 9 can also be provided in the shank 6; this works together with a tip of the threaded pin. The thread draw-off nozzle 1 can thus be fixed particularly well and, if required, can also be positioned in the open-end spinning device 2 with respect to its circumferential direction.

In contrast to the two preceding illustrations, with the present thread draw-off nozzle 1, no ring-shaped adhesive surfaces 11*a*, 11 *b* are provided; rather, an adhesive is introduced completely over the entire area between the two parts, the nozzle frame 4 and the nozzle insert 3. It is understood that such thread draw-off nozzle 1 could also be provided with defined adhesive surfaces 11*a*, 11*b*. It is likewise understood that not only notches, but also any other surface structures, are possible as surface structures 20. In all other respects, the thread draw-off nozzle 1 corresponds to the two previously described nozzles.

Figure 5:
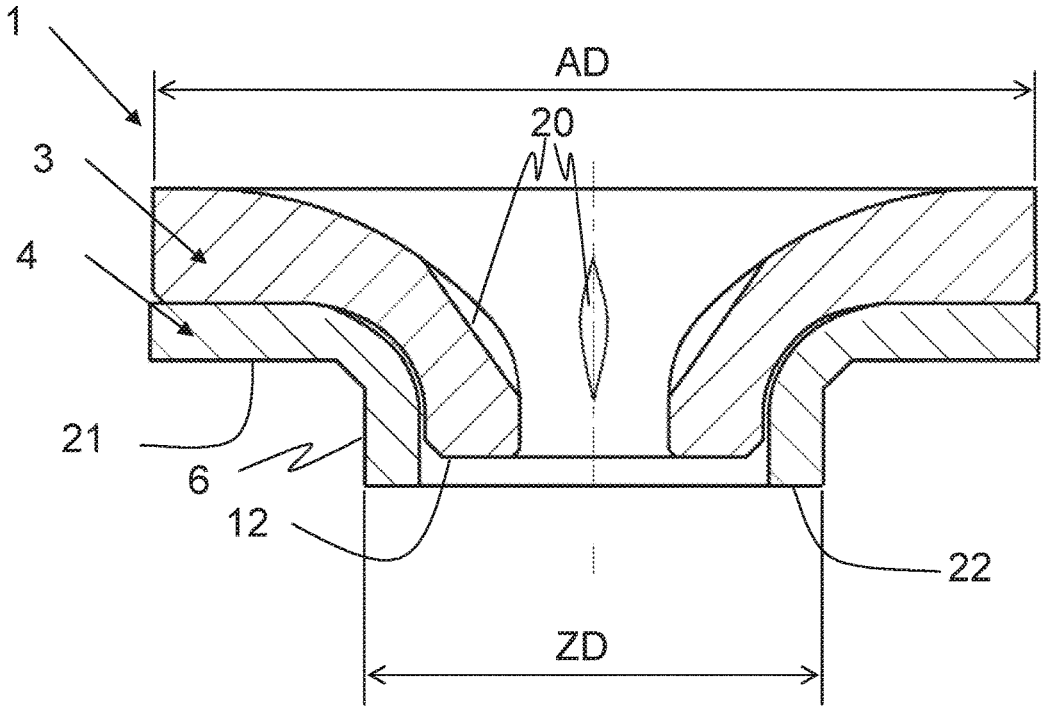
FIG. 5 is a sectional illustration of a thread draw-off nozzle with a nozzle insert and a nozzle frame without a nozzle plate.

Finally, FIG. 5 shows an additional embodiment of a thread draw-off nozzle 1, in which the nozzle frame 4 has no nozzle plate 7. As described above, the thread draw-off nozzle 1 can be fixed with both a magnetic fastener and a threaded pin in the cover element 14, and can also have adhesive surfaces 11*a*, 11*b*. Such a thread draw-off nozzle 1 without a nozzle plate 7 is particularly suitable for a magnetic fastener, since, with this, high forces do not act on the shank 6 of the nozzle frame 4.

The invention is not limited to the illustrated embodiments. Variations and combinations within the framework of the claims also fall under the invention.

LIST OF REFERENCE SIGNS

1 Thread draw-off nozzle
2 Open-end spinning device
3 Nozzle insert
4 Nozzle frame
5 Yarn
6 Shank
7 Nozzle plate
8 Insert
9 Recess
10 Threaded bore
11 Adhesive surface
11*a* Adhesive surface of the nozzle frame
11*b* Adhesive surface of the nozzle insert
12 Lower edge of the nozzle insert
13 Spinning rotor
14 Cover element
15 Receptacle
16 Yarn draw-off channel
17 Rotor groove
18 Rotor housing
19 Fiber feed channel
20 Surface structures
21 Contact surface
22 Lower edge of the nozzle frame
L Length of the shank
ZD Centering diameter
AD Outer diameter

The invention claimed is:

1. A thread draw-off nozzle for an open-end spinning device, comprising:

a nozzle insert configured to deflect a produced yarn;

a nozzle frame that fixes the thread draw-off nozzle in the open-end spinning device, the nozzle frame comprising a cylindrical shank;

the cylindrical shank comprising a centering diameter, and a length that is shorter than half the centering diameter.

2. The thread draw-off nozzle according to claim 1, wherein nozzle frame is formed of a metallic material.

3. The thread draw-off nozzle according to claim 1, wherein the nozzle frame comprises a flat nozzle plate at an end thereof.

4. The thread draw-off nozzle according to claim 1, wherein the nozzle frame is formed of a ferromagnetic material or comprises a ferromagnetic insert.

5. The thread draw-off nozzle according to claim 1, wherein the nozzle insert is formed of a ceramic material.

6. The thread draw-off nozzle according to claim 1, wherein the cylindrical shank comprises a recess located to receive an attachment means that extends through the nozzle frame.

7. The thread draw-off nozzle according to claim 1, wherein the nozzle insert is glued into the nozzle frame.

8. The thread draw-off nozzle according to claim 7, wherein the nozzle frame (4) features a ring-shaped adhesive surface (11*a*) that is oriented in a perpendicular manner to a circumferential surface of the cylindrical shank (6), which corresponds to a ring-shaped adhesive surface (11*b*) of the nozzle insert (3).

9. The thread draw-off nozzle according to claim 1, wherein the nozzle frame comprises a flat nozzle plate at an end thereof, the nozzle plate spaced at a distance from a lower edge of the nozzle insert.

10. The thread draw-off nozzle according to claim 1, wherein the thread draw-off nozzle comprises an outer diameter that is less than 18 mm.

* * * * *